US011353237B2

(12) United States Patent
Hess

(10) Patent No.: US 11,353,237 B2
(45) Date of Patent: Jun. 7, 2022

(54) EXHAUST FAN ASSEMBLY HAVING A SYSTEM FOR AUTOMATICALLY OPENING A DAMPER IN THE EVENT OF A POWER FAILURE

(71) Applicant: Captive-Aire Systems, Inc., Raleigh, NC (US)

(72) Inventor: Joshua J. Hess, Washington Boro, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 244 days.

(21) Appl. No.: 16/680,528

(22) Filed: Nov. 12, 2019

(65) Prior Publication Data

US 2021/0140677 A1 May 13, 2021

(51) Int. Cl.

| | |
|---|---|
| ***F24F 13/14*** | (2006.01) |
| ***F04D 25/06*** | (2006.01) |
| ***F04D 29/40*** | (2006.01) |
| *F24F 140/40* | (2018.01) |

(52) U.S. Cl.

CPC ..... *F24F 13/1426* (2013.01); *F04D 25/06* (2013.01); *F04D 29/40* (2013.01); *F24F 13/1486* (2013.01); *F24F 2013/146* (2013.01); *F24F 2013/1453* (2013.01); *F24F 2140/40* (2018.01)

(58) Field of Classification Search

CPC ..... A62C 37/12; A62C 2/242

USPC ..... 454/369

See application file for complete search history.

(56) References Cited

U.S. PATENT DOCUMENTS

| | | | | |
|---|---|---|---|---|
| 2,854,916 A | | 10/1958 | Knutson et al. | |
| 3,251,158 A | * | 5/1966 | Shapiro | E04D 13/0352 52/1 |
| 3,557,497 A | * | 1/1971 | Schafer | F24F 7/02 52/1 |
| 3,589,065 A | * | 6/1971 | Watson | F24F 7/02 49/7 |

FOREIGN PATENT DOCUMENTS

| | | | |
|---|---|---|---|
| DE | 202005010625 | U1 | 11/2006 |
| EP | 0270297 | A1 | 6/1988 |

* cited by examiner

*Primary Examiner* — Nivek K Shirsat
*Assistant Examiner* — Ko-Wei Lin
(74) *Attorney, Agent, or Firm* — Coats & Bennett, PLLC

(57) ABSTRACT

An exhaust fan configured to exhaust air from a building includes a housing, a fan, and a motor for driving the fan. Overlying the fan is one or more dampers that are moveable from a closed position to an open position. Underlying the dampers is at least one pivot arm per damper that is pivotally connected to the fan and which normally assumes a horizontal position spaced from the overlying damper. A mechanical fusible link is connected to the pivot arm and is configured to break in response to a buildup of heat in and around the dampers. Once the fusible link breaks, then the pivot arm is operative to engage and open the overlying damper.

18 Claims, 8 Drawing Sheets

EXHAUST FAN ASSEMBLY HAVING A SYSTEM FOR AUTOMATICALLY OPENING A DAMPER IN THE EVENT OF A POWER FAILURE

FIELD OF THE INVENTION

The present invention relates to exhaust fans employed to exhaust air from a building, and more particularly to a system and process employed in exhaust fans for opening one or more dampers of the exhaust fan in the event of a power failure.

BACKGROUND

Exhaust fans are employed to exhaust air from buildings. They typically include a fan driven by an electric motor. Further, they typically include one or more dampers that are open by the force of air being induced upwardly through the exhaust fan. Thus if there is a power failure, the motor fails to drive the fan and the dampers remain closed. Yet in the case of a commercial kitchen, for example, hot air is still produced and tends to accumulate in the exhaust fan due to the dampers being closed. Thus, it can get extremely hot in and around the motor and this can damage the motor and at the same time present a fire hazard.

Therefore, there is a need for a simple and reliable damper control for a building exhaust fan that will automatically open the dampers in response to a buildup of heat in the exhaust fan due to a power or motor failure.

SUMMARY OF THE INVENTION

The present invention entails an exhaust fan configured to exhaust air from a building, such as a building housing a commercial kitchen. The exhaust fan includes a housing, a fan mounted in the housing, and a motor for driving the fan. Overlying the fan and motor is one or more dampers that are moveable from a closed position to an open position. Underlying the dampers is a pivot arm that is pivotally connected in the fan assembly and which normally assumes a generally horizontal position spaced from the overlying damper. A mechanical fusible link is connected to the pivot arm and normally holds the pivot arm in the generally horizontal position. But in the event of a power failure or a failure of the motor, the dampers remain closed and there can be a buildup of heat in and around the dampers. This buildup of heat causes the mechanical fusible link to break. The pivot arm is biased upwardly by a gas spring piston and when the fusible link breaks, the gas spring piston is extended and in the process pushes the pivot arm up, which results in the pivot arm engaging the overlying damper and moving the damper from the closed position to the open position, thereby enabling the hot air to escape via the exhaust fan.

In another embodiment, the pivot arm includes a remote end opposite a pivot end. Secured to the housing of the exhaust fan is a latching bracket. The remote end of the pivot arm includes a latch that is connectable to the latching bracket. By securing the latch to the latching bracket, the pivot arm is held down against the bias of the gas spring piston. This enables the mechanical fusible link to be easily secured to the pivot arm after which the latch is disengaged from the latching bracket.

Other objects and advantages of the present invention will become apparent and obvious from a study of the following description and the accompanying drawings which are merely illustrative of such invention.

DESCRIPTION OF PREFERRED EMBODIMENT

Figure 1:
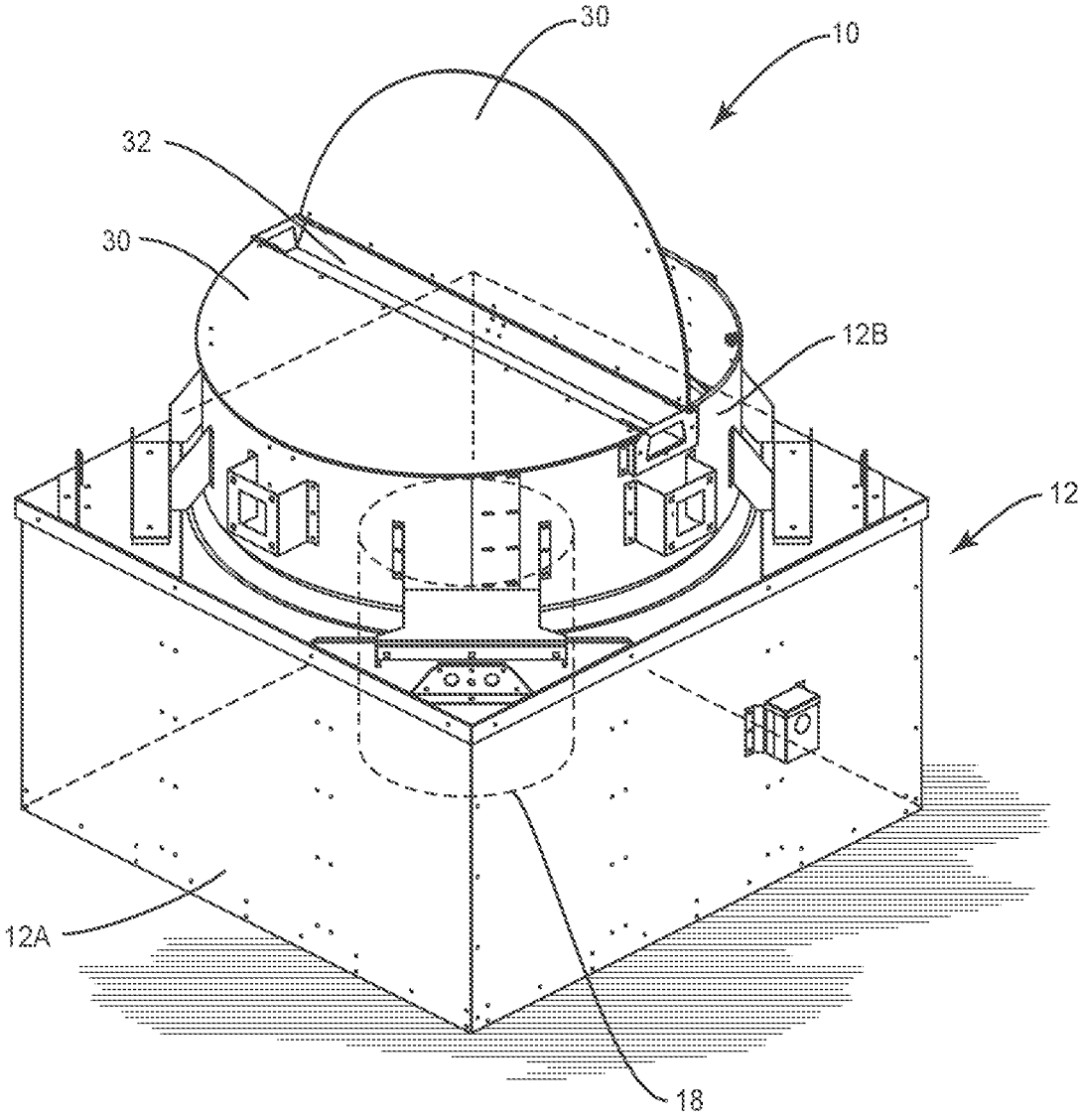
FIG. 1 is a perspective view of the exhaust fan assembly.
Figure 2:
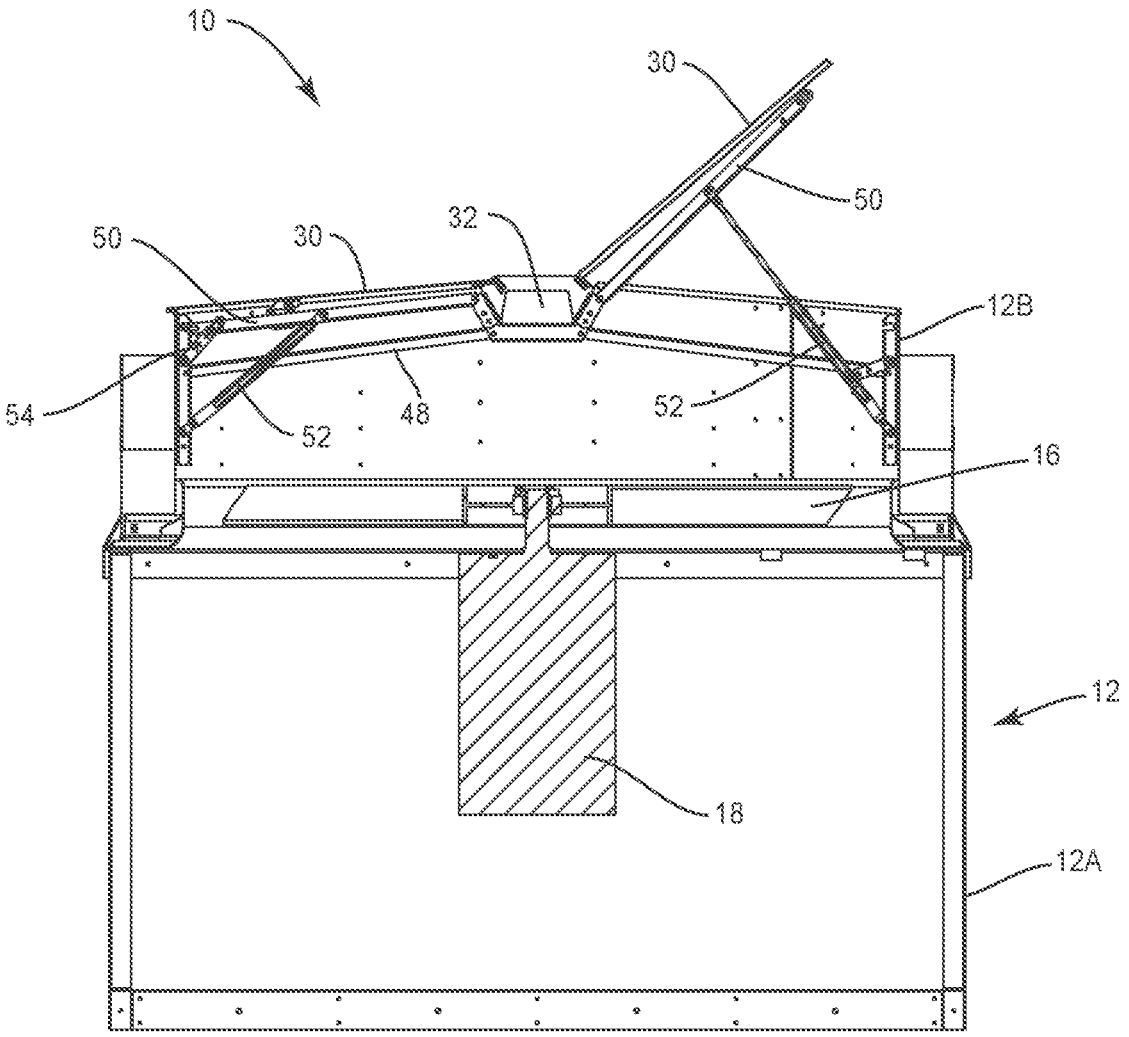
FIG. 2 is a side elevational view of the exhaust fan assembly with portions of the housing removed to illustrate the internal structure thereof.
Figure 3:
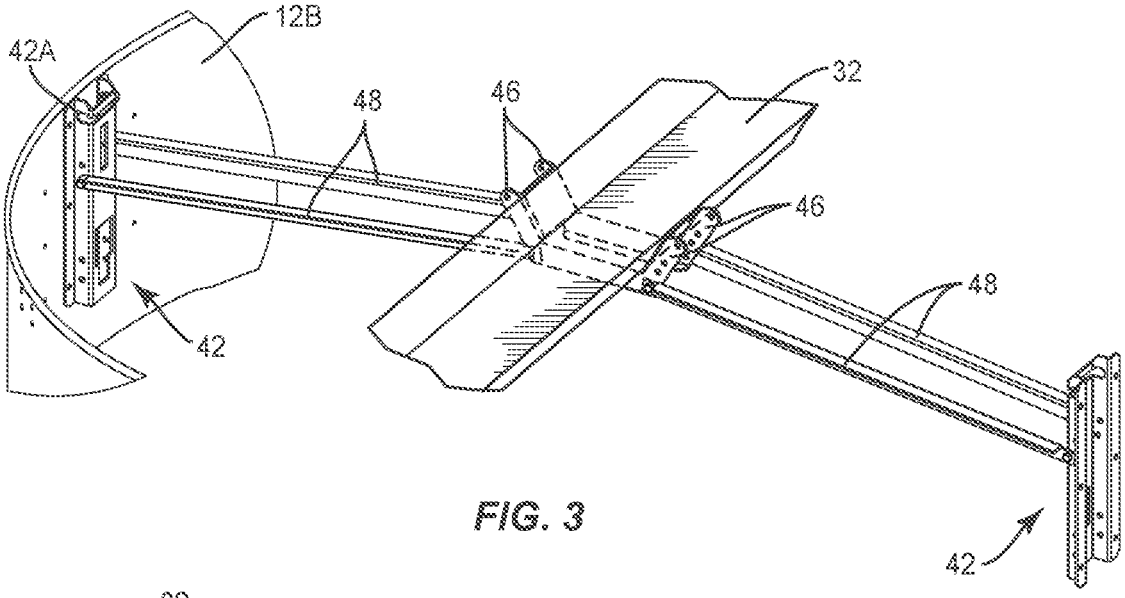
FIG. 3 is a fragmentary perspective view showing a portion of a gutter that lies between two dampers.

With further reference to the drawings, an exhaust fan is shown therein and indicated generally by the numeral 10. See FIG. 1. In the embodiment illustrated, the exhaust fan 10 is what is generally referred to as an upblast type. It is understood and appreciated by those skilled in the art that the present invention can easily be employed with a downblast type exhaust fan. Exhaust fan 10 can be used for general ventilation or can be used in conjunction with a commercial kitchen to exhaust smoky and grease laden air that emanates from a cooking surface generally disposed underneath a hood.

Exhaust fan 10 includes a housing indicated generally by the numeral 12. It is appreciated that the specific design and construction of the housing can vary from one application to another. In any event, in the embodiment illustrated herein, the housing 12 includes an outer housing 12A that can assume a generally rectangular or square form or other forms. Housing 12 further includes an upper housing 12B that extends upwardly from the outer housing 12A and functions as an air duct for directing exhaust air upwardly through a portion of the exhaust fan. Upper housing 12B is sometimes referred to as an airshaft. In the embodiment illustrated, the upper housing assumes a generally circular form.

Exhaust fan 10 is provided with means for inducing air to move upwardly through the exhaust fan where the air is exhausted to the atmosphere. In some applications, the housing 12A can be mounted on a curb (not shown) that leads to a duct structure within the building. Hence, in the case of the use of a curb, the exhaust air moves from the building through the curb and then through the exhaust fan 10. Various fan and motor arrangements can be incorporated into the exhaust fan 10. In an exemplary embodiment, the exhaust fan includes a propeller 16 which is directly driven by a motor 18. Note that the propeller 16 and motor 18 are axially aligned with the upper circular housing or airshaft 12B. It is appreciated by those skilled in the art that a fan wheel may be used in lieu of the propeller 16. It is understood and appreciated by those skilled in art that other types of fans can be incorporated into the exhaust fan 10. As noted above, in the arrangement shown in the drawings, the propeller 16 is directly driven by the motor 18. Generally when a direct drive is employed, the propeller 16 is essentially mounted to the drive shaft of the motor 18 or to an extension therefrom. In other cases, the fan wheel or propeller can be driven from a side mounted motor through a belt drive.

Supported at the outlet end of the upper housing 12B are one or more dampers 30. In the embodiment shown herein, there is provided two dampers 30 with the dampers being pivotally mounted about transverse axes about the top of the upper housing 12B. Thus, the dampers are supported, at least indirectly, by the upper housing or airshaft 12B. As seen in the drawings, the dampers 30 are disposed over the propeller 16 and motor 18. Since the dampers 30 are pivotally mounted, they are moveable from a generally horizontally closed position to a raised or inclined open position. See FIG. 1 where one of the dampers 30 assumes the closed position while the other damper assumes the open position.

Disposed between the inboard edges of the damper 30 is a gutter 32. Note that the gutter 32 forms a trough between the inboard edges of the dampers 30. Gutter 32 and the dampers 30 are configured such that when the dampers assume the closed position, rainwater will flow from the surface of the dampers into the gutter 32 and be discharged out the side of the fan assembly 10.

In normal operations, the force of the air being exhausted upwardly through the exhaust fan 10 is sufficient to open the dampers 30 so as to permit the exhaust air to escape. However, there can be cases where there is an electricity failure or a failure in the motor 18. In either case, there is no air passing through the exhaust fan to open the dampers 30. This becomes a concern because the air underlying damper and surrounding the motor becomes heated and this extremely hot air can damage the motor 18 and may present a fire hazard. Thus, the focus of the present invention is to provide an exhaust fan with some means to automatically open the dampers 30 when there is an electricity or motor failure.

To address this problem, a damper actuator assembly, indicated generally by the numeral 40, is provided. See FIGS. 3-6, for example. At the center of the damper actuator assembly 40 is at least one pivot arm indicated generally by the numeral 50. Details of the pivot arm 50 will be discussed subsequently. The function of the pivot arm which lies below the dampers 30 is to pivot from a generally horizontal position to a raised position where the pivot arm engages the underside of the dampers and pivots the dampers to an open position.

Figure 4:
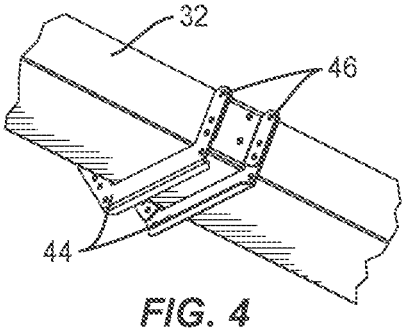
FIG. 4 is a fragmentary perspective view showing support structure underlying the gutter.
Figure 5:
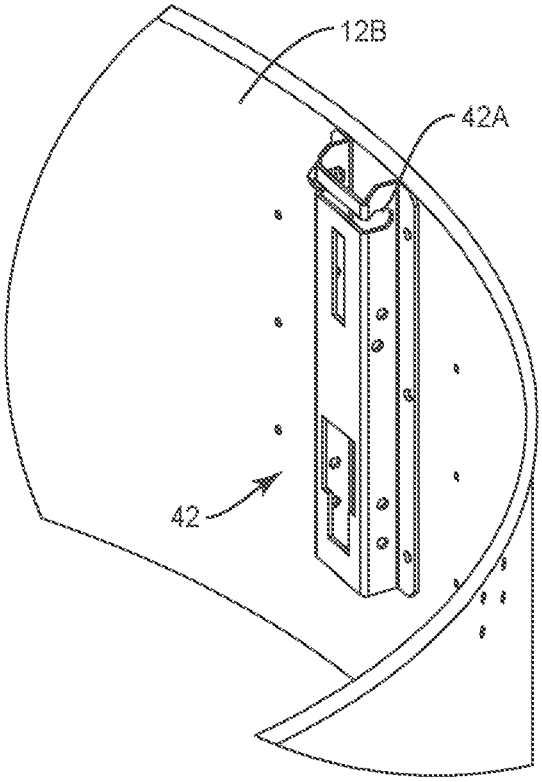
FIG. 5 is a fragmentary perspective view showing a portion of the airshaft and a latching bracket secured to the interior side thereof.
Figure 6:
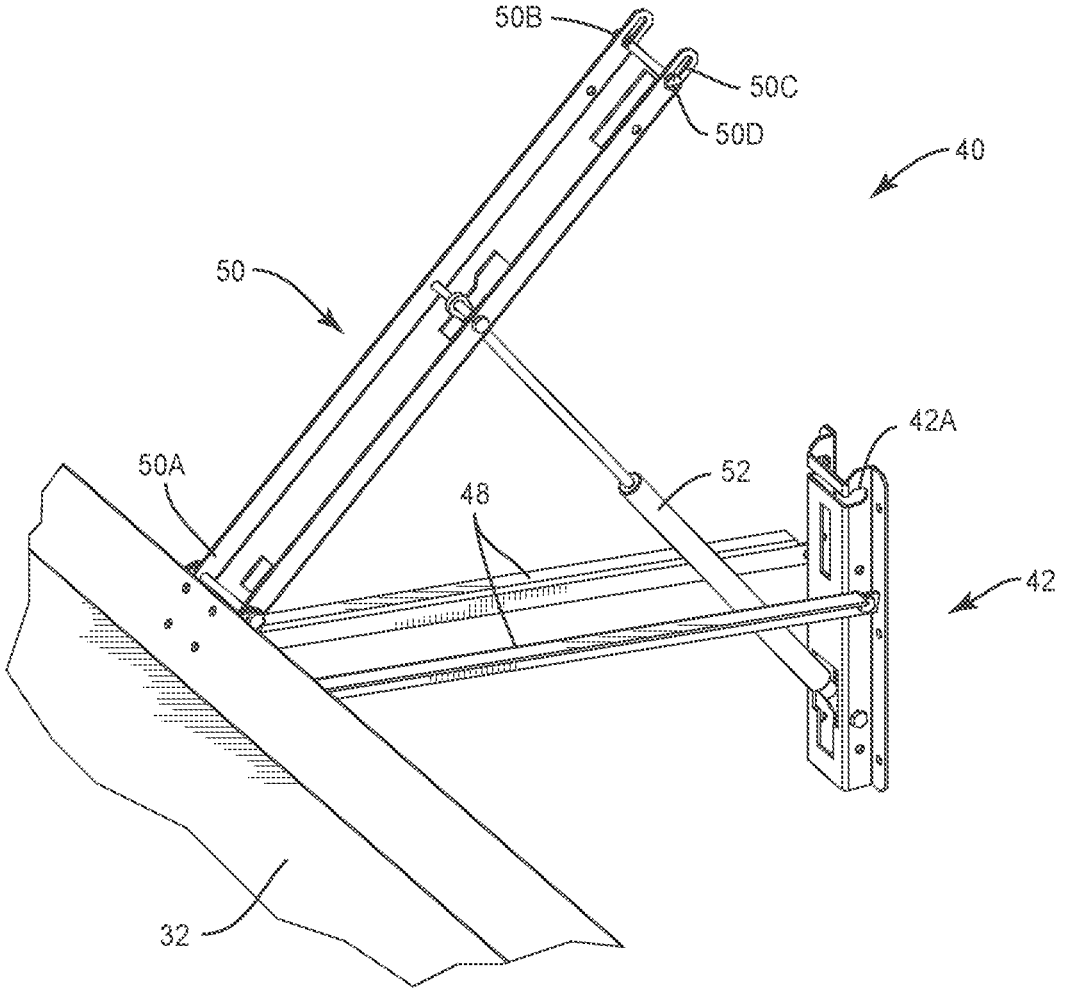
FIG. 6 is a fragmentary perspective view showing the damper actuator assembly with the pivot arm disposed in a raised or elevated position.

Now an example of the structure (including the pivot arm 50) of the damper actuator assembly 40 is discussed. Note FIGS. 3-5. Shown here is a pair of latching brackets indicated generally by numeral 42. Each latching bracket is secured to the inner surface of the airshaft 12B. Latching brackets 42 are generally transversely aligned. As shown in FIG. 4, there is a pair of U-shaped pivot supports 44 secured underneath the gutter 32. Supports 44 are secured by rivets or other suitable fastening means to the underside of the gutter 32. Note that the U-shaped pivot supports 44 include outer terminal end portions that are referred to as support fingers 46. See FIGS. 3 and 4. Extending between the U-shaped pivot supports 44 and the latching brackets 42 is a series of parallel supports 48. See FIG. 3. In particular there is a pair of parallel supports 48 that extend from opposite sides of the gutter 32 to the latching brackets 42. These parallel supports 48 tend to support the gutter 32.

Figure 7:
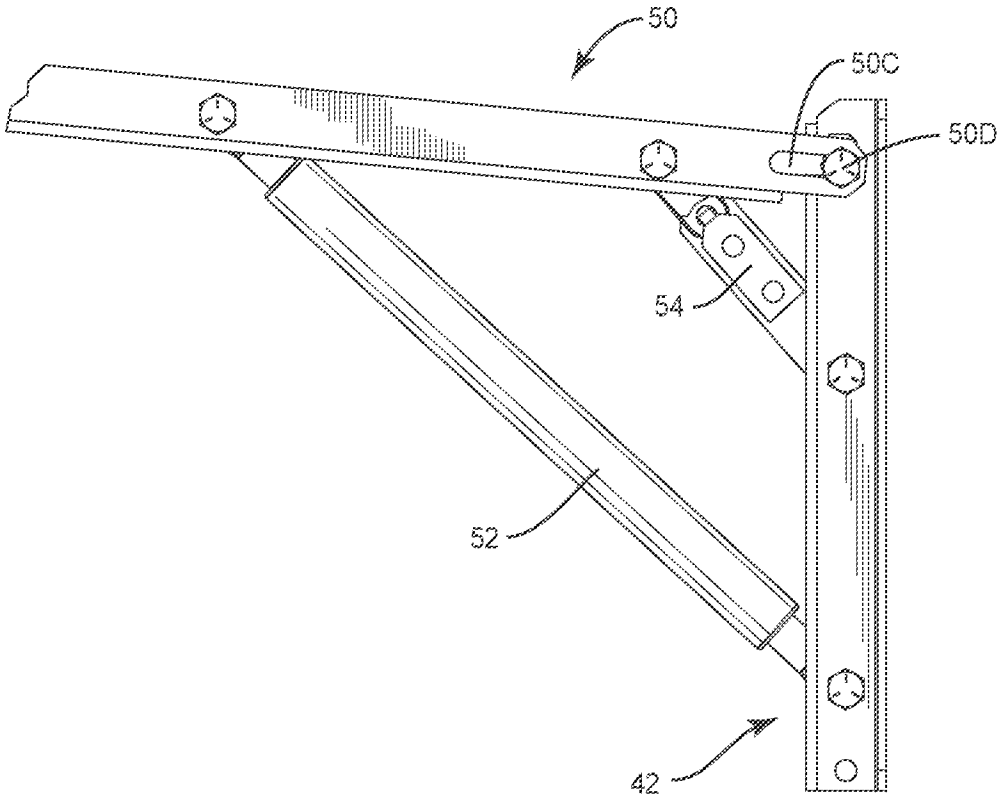
FIG. 7 is a fragmentary side elevational view of a portion of the damper actuator assembly and illustrating a mechanical fusible link that holds the pivot arm in a horizontal position.
Figure 8:
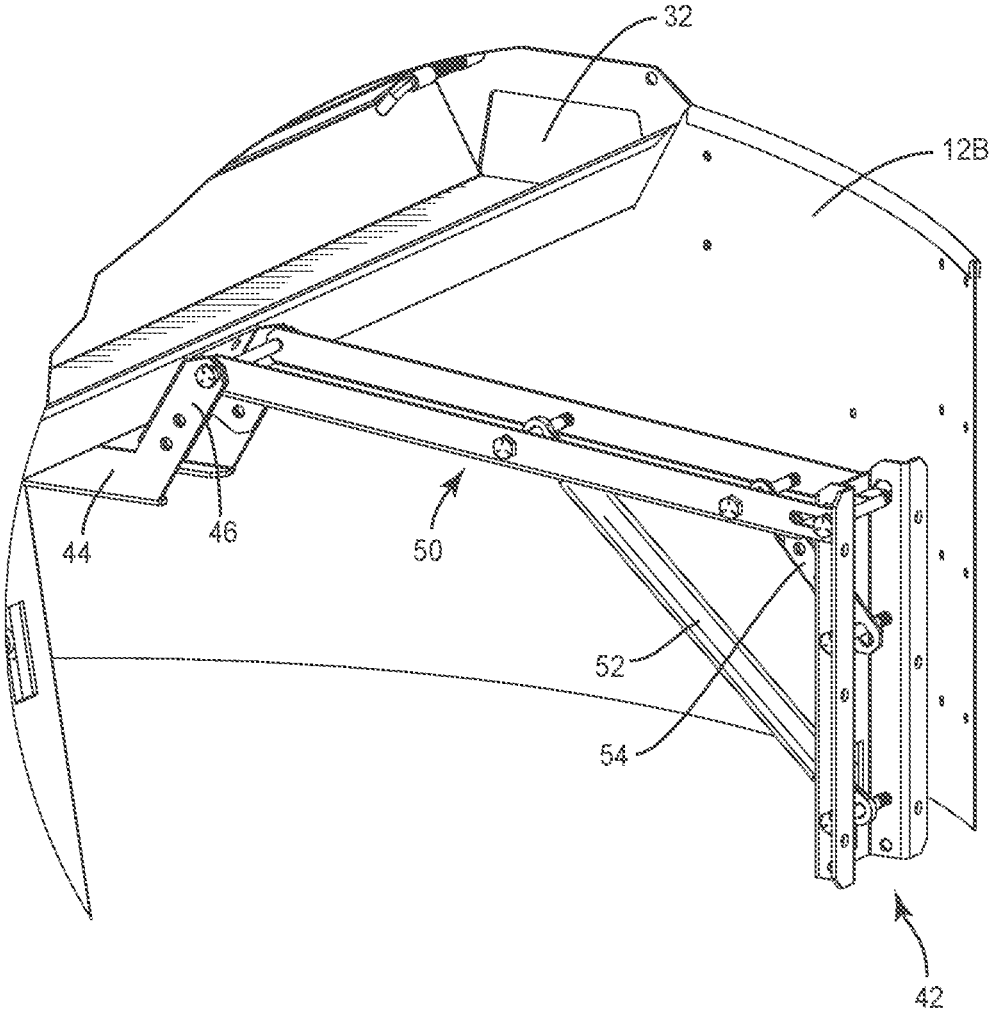
FIG. 8 is a fragmentary perspective view of a portion of the damper actuator assembly and which shows the mechanical fusible link holding the pivot arm in the normal horizontal position.

Two exemplary designs for the pivot arm 50 are shown in the drawings. In one case, a single pivot arm is used to actuate a damper 30. See FIGS. 6-8. In another case, dual pivot arms are employed to actuate the damper. First, the single pivot arm embodiment shown in FIGS. 6-8 will be discussed. The pivot arm includes a pivot end 50A and a remote end 50B. See FIG. 6. Formed in the remote end 50B of the pivot arm 50 are two elongated slots 50C. A locking pin 50D is slideably contained in the slots 50C and as will be discussed subsequently herein, the locking pin is used to lock the pivot arm 50 to the latching bracket 42 for purposes of assembly or shipment.

Pivot arm 50 includes a generally shallow U-shaped channel that includes a series of cutouts formed in a web that forms a part of the pivot arm. Note that the pivot end 50A is pivotally mounted about a pivot pin to respective support fingers 46. Hence pivot arm 50 can pivot back and forth about the pivot axis thereof.

When the two dampers 30 assume a closed position, a pair of pivot arms 50 are disposed underneath the dampers. The pivot arms can be slightly spaced below the dampers 30 or can slightly engage the underside of the dampers when the dampers assume the closed position. Pivot arm 50 is moveable from a generally horizontal position shown in FIG. 8 to a raised position shown in FIG. 6. It is appreciated that as the pivot arm 50 moves from the generally horizontal position to the raised position, it will engage the overlying damper 30 and opens the same.

Pivot arm 50 is biased to move to the raised position. This is achieved by providing a gas spring piston 52 and connecting the piston between one latching bracket 42 and an intermediate point on the pivot arm. In particular, note that the base of the gas spring piston 52 is pivotally connected to a lower portion of the latching bracket 42 while the rod end is connected to a pivot pin that extends across a cutout formed in the web of the pivot arm.

It is therefore necessary to hold the pivot arm 50 in the general horizontal position against the bias of the gas spring piston 52 until there is a need to open the dampers 30. To accomplish this, the damper actuator assembly 40 includes a mechanical fusible link 54 that is operatively connected between one latching bracket 42 and the pivot arm 50. See FIG. 7. In particular, the mechanical fusible link 54 is pivotally connected to both the latching bracket 42 and the pivot arm 50. Details of the mechanical fusible link 54 are not dealt with herein because such is not per se material to the present invention and further such mechanical fusible links are well known and appreciated by those skilled in the art. Suffice it to say that one example of a mechanical fusible link is a device that includes two strips of metal soldered together with a fusible alloy that is designed to melt at a specific temperature which allows the two pieces to fracture and separate. Mechanical fusible links come in a variety of designs and different temperature ratings. In one exemplary embodiment, it is desirable to select a mechanical fusible link that will break when exposed to a temperature in the range of 165° F.

In order to connect the mechanical fusible link 54 between the latching bracket 42 and the pivot arm 50, it is desirable to have some means for locking or stationing the pivot arm in the generally horizontal position. This is because, as a practical matter for this design, it is desirable to install the gas spring piston 52 before installing the mechanical fusible link 54. A gas spring piston is a type of spring that, similar to typical mechanical springs, relies on elastic deformation, and uses compressed gas contained within an enclosed cylinder sealed by a sliding piston to pneumatically store potential energy and withstand at least some external force applied parallel in the direction of the piston. Thus, because the gas spring piston is biased to extend, the force exerted by the piston must be overcome while connecting the mechanical fusible link 54. To make this as simple and easy as possible, the damper actuator assembly 40 provides a means to lock the pivot arm 50 in the horizontal position. This is achieved by pushing down the pivot arm against the bias of the gas spring piston 52 until the remote end 50B of the pivot arm aligns with a slot 42A formed in the latching bracket 42. Once alignment is achieved, then the locking pin 50D can be slid into the slot 42A and this will lock the pivot arm 50 in the generally horizontal position so that the mechanical fusible link 54 can be easily installed. The locked configuration may be maintained while the exhaust fan 10 is being handled or in shipment. However, once the exhaust fan is made operational on a site, the locking pin 50D is retracted from the slot 42A. Now the mechanical fusible link is what holds the pivot arm 50 in the horizontal position.

In normal use, electricity is provided to the motor 18 and by driving the propeller 16, a sufficient quantity of air is exhausted so as to maintain the dampers 30 in at least a partial open position. But in the event of an electricity failure or a motor failure, there is no air to open the dampers 30. This in many instances will result in a buildup of heat underneath the dampers 30. This heat, when it reaches a temperature of approximately 165° F. or higher, will cause the mechanical fusible link 54 to strategically melt, which in turn causes the link to break. At this point there is no downward force holding the pivot arm 50 in the horizontal position. Now the gas spring piston 52 is operative to extend and in doing so pushes the pivot arm 50 upwardly where it engages and opens the overlying damper 30.

It is stated that the mechanical fusible link breaks in response to an area below the closed damper heating up. This means that once the temperature in the area below the closed damper heats up to 165° F. or higher that the fusible link will break.

Figure 9:
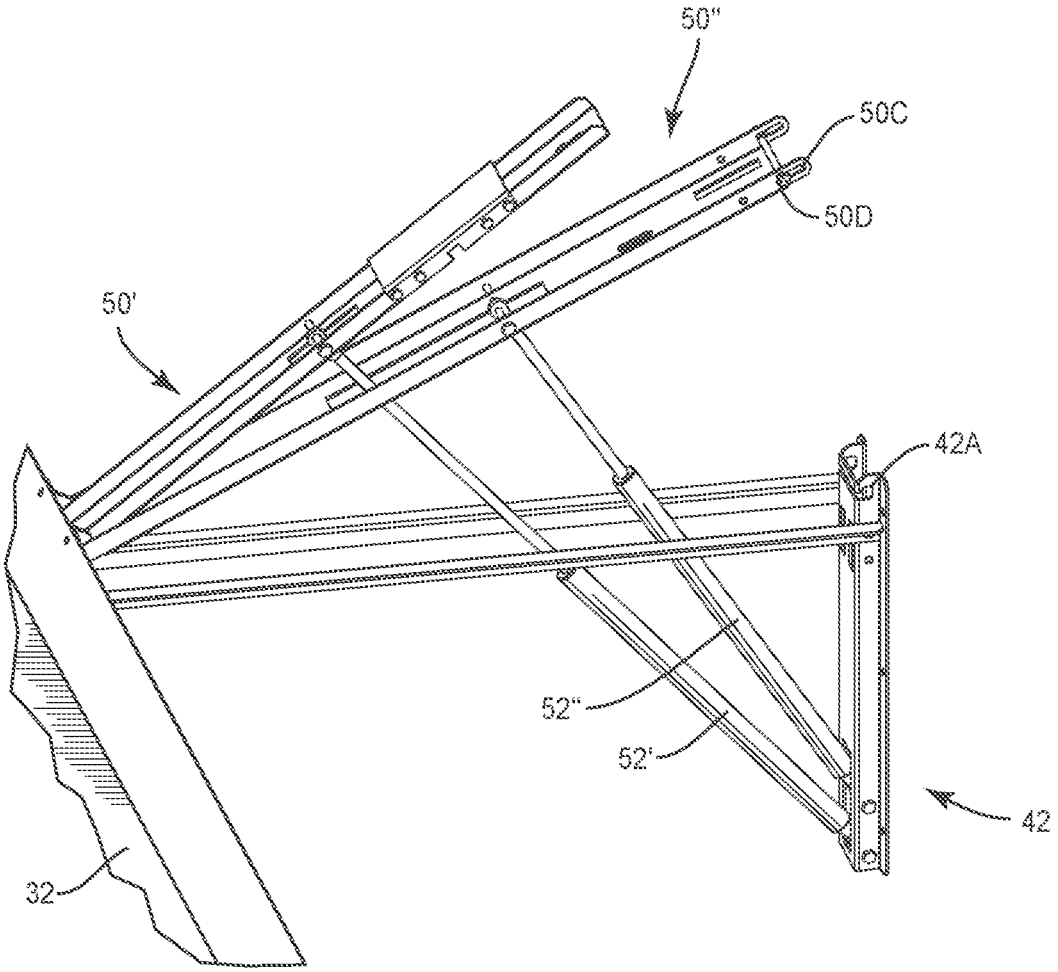
FIG. 9 is a fragmentary perspective view showing an alternative design that includes a pair of pivot arms that are employed to open an overlying damper in an emergency situation.
Figure 10:
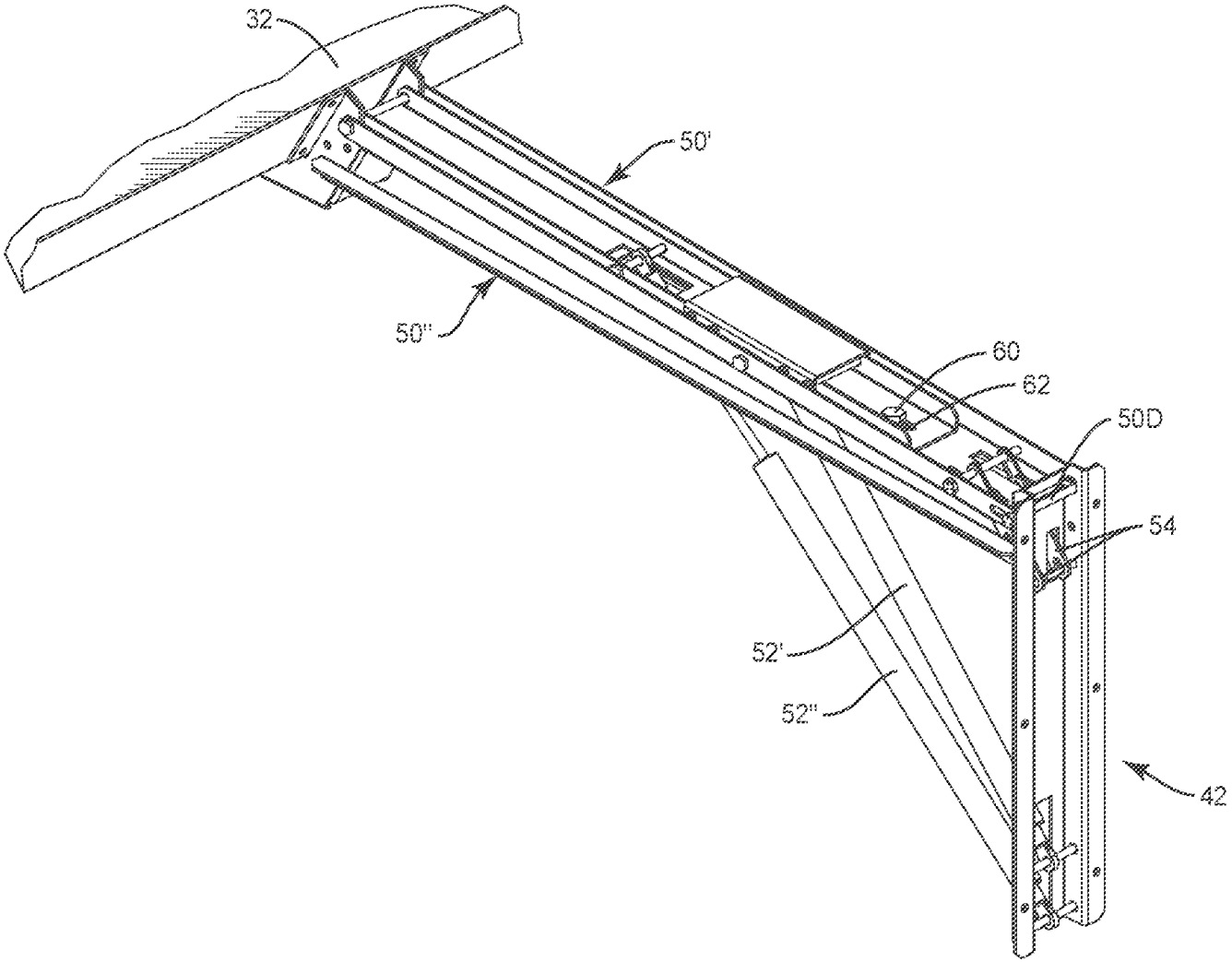
FIG. 10 is a fragmentary perspective view of the embodiment shown in FIG. 9 but with the pair of pivot arms being secured and held in their normal horizontal position by the mechanical fusible link.

Another embodiment of the damper actuator is shown in FIGS. 9 and 10. In this case, the damper actuator includes two pivot arms 50' and 50". This design is suited for a situation where the damper 30 is relatively large. Large dampers require more force from the gas spring piston 52 in order to achieve an open status. This in turn impacts the force required to push down the pivot arm in order to connect the mechanical fusible link 54. In some cases, the force is so great that it is difficult, if not impossible, to manually push down the pivot arm 50. To address this concern, the embodiment shown in FIGS. 9 and 10 is provided with two pivot arms 50' and 50" and two gas spring pistons 52' and 52". By pushing each pivot arm down separately, this effectively reduces the force required to push down the pivot arms in half. Yet together they provide sufficient force to open such a relatively large damper.

As illustrated in FIGS. 9 and 10, the pivot arms 50' and 50" are pivotally secured about separate axes. One pivot arm 50' is disposed generally over the other pivot arm 50". As noted above, when they are secured together, they work as a unit. Pivot arms 50' and 50" are provided with means to secure them together. In the embodiment illustrated in FIGS. 9 and 10, a locking bolt 60 is disposed in a slot in pivot arm 50". Locking bolt 60 can slide back and forth in the slot. A keyway 62 is provided in the upper pivot arm 50'. This keyway 62 generally overlies the locking bolt 60. To lock the pivot arms 50' and 50" together, the lower pivot arm 50" is pushed down and held in the down position until the fusible link or links 54 are secured between the latching bracket 42 and the lower pivot arm. After that, the upper pivot arm 50' is pushed down to where it closely overlies the lower pivot arm 50". Now the locking bolt 60 can be extended into the keyway 62 and moved therein to a portion of the keyway that will retain the locking bolt and effectively interlock the pivot arms 50' and 50" together. In some cases, it may be necessary to provide the locking bolt 60 with a nut that can be tightened down in order to form a secure relationship between the pivot arms 50' and 50".

Basically, the double pivot arms 50' and 50" function the same as the single pivot arm discussed above and shown in FIGS. 6-8. In the embodiment shown in FIGS. 9 and 10, a pair of fusible links 54 are employed. This means that both fusible links 54 must be broken through exposure to heat in order for the two pivot arms 50' and 50" to deploy. It is appreciated, however, by those skilled in the art, that one or more fusible links 54 can be employed in any of these embodiments.

The term "configured to" is used in the specification and claims. That term "configured to" means designed to.

From the foregoing discussion, it is appreciated that the damper actuator assembly 40 serves an important and useful function when there is a power failure or when the motor 18 fails to operate. When this occurs, there is a significant buildup of heat in the range of 62° F. or higher. When this buildup of heat occurs, the mechanical fusible links fail and the damper actuator assembly 40 functions to open the one or more dampers 30 associated with the exhaust fan.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A rooftop exhaust fan for exhausting air from a building comprising:

a fan assembly including a housing, a motor disposed in the housing, and a fan driven by the motor and configured to induce air to move from the building through the fan assembly;

one or more dampers moveably mounted to the fan assembly above the motor and fan and configured to move from a generally horizontal closed position to an open position where in the open position exhaust air moves upwardly through the fan assembly;

a damper actuator assembly configured to open the one or more dampers in response to an electricity failure or a motor failure, the damper actuator assembly comprising:

i. at least one pivot arm disposed underneath the one or more dampers and configured to move from a generally horizontal position to a raised position where the at least one pivot arm engages the one or more dampers and moves the one or more dampers to the open position;

ii. a mechanical fusible link connected to the at least one pivot arm and configured to normally hold the at least one pivot arm in the generally horizontal position;

iii. a gas spring piston extending from the fan assembly to the at least one pivot arm, the gas spring piston being biased to move from a retracted position to an extended position;

wherein the mechanical fusible link is heat sensitive and configured to break in response to being exposed to a threshold temperature;

in response to the mechanical fusible link breaking, the gas spring piston is configured to move from the retracted position to the extended position and to move the at least one pivot arm which in turn engages the one or more dampers and raises the one or more dampers to the open position such that exhaust air be exhausted upwardly past the one or more dampers; and whereby in response to the mechanical fusible link breaking, the at least one pivot arm raises and engages the one or more dampers and moves the one or more dampers to the open position.

2. The exhaust fan of claim 1 further including a latching bracket secured to the fan assembly, and wherein the at least one pivot arm includes a latch configured to engage the latching bracket and to secure the at least one pivot arm to the latching bracket.

3. The exhaust fan of claim 2 wherein the housing includes an outer wall and wherein the at least one pivot arm is pivotally connected at a point spaced inwardly from the outer wall and projects outwardly towards the outer wall and wherein the at least one pivot arm includes an outer terminal end that terminates adjacent the latching bracket when the at least one pivot arm assumes the generally horizontal position.

4. The exhaust fan of claim 2 wherein the at least one pivot arm includes a pivot end and wherein the outer end portion of the at least one pivot arm includes a pair of parallel channels and a locking pin slideable in the channels and configured to latch to the latching bracket.

5. The rooftop exhaust fan of claim 1 wherein the at least one pivot arm includes an inner end portion disposed generally centrally in the fan assembly and an outer end portion that is disposed adjacent a wall forming a part of the housing and wherein the inner end portion of the at least one pivot arm is pivotally mounted about a pivot pin and wherein the at least one pivot arm projects outwardly from the pivot pin toward the wall of the housing.

6. The exhaust fan of claim 2 wherein the mechanical fusible link is pivotally connected at one end to the latching bracket and pivotally connected at the other end to the at least one pivot arm; and wherein the gas spring piston is pivotally connected at one end to the latching bracket and pivotally connected at the other end to the at least one pivot arm.

7. The exhaust fan of claim 6 wherein the at least one pivot arm comprises a generally U-shaped channel having a pair of spaced apparat cutouts formed therein, and wherein there is provided a connector that extends across each cutout for pivotally connecting to the mechanical fusible link and the gas spring piston.

8. The exhaust fan of claim 1 including a pair of pivot arms, one disposed over the other, and wherein each pivot arm is powered by a separate gas spring piston.

9. The exhaust fan of claim 8 including means for interlocking the pair of pivot arms together.

10. An exhausts fan for exhausting air from a building, comprising:

a fan assembly including a housing, a fan and a motor operatively connected to the fan for driving the same;

a pair of dampers disposed over the fan and motor, each damper pivotally mounted about a transverse axis and moveable from a generally horizontal closed position to an open position where exhaust air passes through the open damper;

at least one pivot arm mounted underneath each damper;

the at least one pivot arm having an inner end portion pivotally mounted to the fan assembly and an outer end portion, and wherein the at least one pivot arm is configured to move from a generally horizontal position to a raised position where the at least one pivot arm engages the overlying damper and moves the damper to the open position;

a mechanical fusible link connected between the at least one pivot arm and the fan assembly and configured to normally maintain the at least one pivot arm in the general horizontal position;

an actuator operatively connected between the fan assembly and the at least one pivot arm and configured to bias the at least one pivot arm upwardly towards the raised position, the actuator moveable from a retracted position to an extended position where the actuator causes the at least one pivot arm to move from the generally horizontal position to the raised position; and the mechanical fusible link normally holding the at least one pivot arm in the general horizontal position against the bias of the actuator, but wherein the mechanical fusible link is configured to break in response to exposure to a threshold temperature;

wherein when the mechanical fusible link breaks, the actuator moves the at least one pivot arm from the general horizontal position to the raised position where the at least one pivot arm engages and raises the respective overlying damper.

11. The exhaust fan of claim 10, wherein the at least one pivot arm includes including a pair of pivot arms, wherein each of the pair of pivot arms pivot arm being connected to a separate actuator.

12. The exhaust fan of claim 11 including means for interlocking the pair of two pivot arms.

13. The exhaust fan of claim 10 further including a latching bracket secured to the fan assembly, and wherein the least one pivot arm includes a latch configured to engage the latching bracket and to secure the least one pivot arm to the latching bracket.

14. The exhaust fan of claim 12 wherein the at least one pivot arm includes a pivot end and an outer end portion and wherein the outer end portion includes a pair of parallel channels and a locking pin slideable in the channels and configured to latch to the latching bracket.

15. The exhaust fan of claim 10 wherein the mechanical fusible link is pivotally connected at one end to a latching bracket and pivotally connected at the other end to the at least one pivot arm; and wherein the actuator comprises a gas spring piston pivotally connected at one end to the latching bracket and pivotally connected at the other end to the at least one pivot arm.

16. A method of automatically opening a damper of a rooftop exhaust fan in the event of an electricity failure wherein the exhaust fan comprises a housing, a fan mounted in the housing, a motor for driving the fan, and the damper disposed over the motor and fan and moveable from a closed position to an open position, the method comprising:

positioning at least one pivot arm generally horizontally underneath the damper where the at least one pivot arm is spaced from the damper and does not engage the damper, and wherein the at least one pivot arm is pivotally connected in the exhaust fan and moveable from a generally horizontal position to a raised position;

holding the at least one pivot arm in the generally horizontal position by connecting a heat sensitive mechanical fusible link between the at least one pivot arm and an anchor point;

biasing the at least one pivot arm upwardly towards the raised position by connecting a gas spring piston between the at least one pivot arm and a second anchor point; and in response to an area below the closed damper heating up, breaking the mechanical fusible link, moving the at least one pivot arm from the generally horizontal position upwardly via the gas spring piston and engaging the overlying damper and pushing the damper to the open position, thereby exhausting hot air from the fan assembly without the aid of the motor or fan.

17. The method of claim 16, wherein the at least one pivot arm includes two pivot arms, and the method further comprising connecting the gas spring piston to one of the two pivot arms and an another gas spring piston to the other of the two pivot arms.

18. The method of claim 16 wherein the at least one pivot arm includes a pivot end and a remote end and wherein prior to connecting the mechanical fusible link to the at least one pivot arm, the method including securing the remote end to a latching bracket secured to the housing of the fan assembly.

* * * * *